United States Patent [19]

Sprang

[11] Patent Number: 4,604,763

[45] Date of Patent: Aug. 12, 1986

[54] SEAL MEANS FOR A FLUSH VALVE ASSEMBLY

[75] Inventor: Richard W. Sprang, Lakeville, Ohio

[73] Assignee: Clevepak Corporation, Purchase, N.Y.

[21] Appl. No.: 703,050

[22] Filed: Feb. 19, 1985

[51] Int. Cl.[4] ..... E03D 1/34

[52] U.S. Cl. ..... 4/391

[58] Field of Search ..... 4/378, 395, 383, 389–391, 4/397–401

[56] References Cited

U.S. PATENT DOCUMENTS

| | | | |
|---|---|---|---|
| 1,069,658 | 8/1913 | Drew | 4/389 X |
| 3,890,652 | 6/1975 | Fulton | 4/391 |
| 4,357,720 | 11/1982 | Stahli | 4/391 X |

FOREIGN PATENT DOCUMENTS

| | | | |
|---|---|---|---|
| 1246263 | 10/1960 | France | 4/395 |
| 900444 | 7/1962 | United Kingdom | 4/391 |

*Primary Examiner*—Charles E. Phillips

*Attorney, Agent, or Firm*—Renner, Kenner, Greive, Bobak & Taylor

[57] ABSTRACT

A flush valve assembly (10) for a water closet having a reservoir tank (12) with a discharge opening (15). The flush valve assembly (10) incorporates a spud (13) having a tubular body portion (14) which presents an annular groove (55) that extends peripherally of the body portion (14) in close proximity to its axially upper rim (88). The tubular body portion (14) is received in the discharge opening (15) of the tank (12). The radial groove (55) supports a cantilevered diaphragm (51) which extends radially outwardly therefrom. The spud (13) also includes a guide (35) having a vent tube (40) slidably received thereon. The guide (35) extends axially upwardly from the body portion (14) of the spud (13) to be positioned interiorly of the tank (12). The lower portion of the vent tube (40) presents a skirt (45) which extends outwardly and downwardly to define a circular valve seat (49) for selective, sealing engagement with the diaphragm (51). An anticavitation plate (75) is positioned interiorly of the skirt (45) and extends radially between the skirt (45) and the vent tube (40).

4 Claims, 5 Drawing Figures

SEAL MEANS FOR A FLUSH VALVE ASSEMBLY

TECHNICAL FIELD

The present invention relates generally to flush valve assemblies for water closets. More particularly, the present invention relates to flush valve assemblies wherein the valving function is conjoined with the venting and overflow functions in a single, "coupled" assembly. Specifically, the present invention relates to an improved sealing configuration particularly suitable for incorporation in a coupled valve assembly.

BACKGROUND ART

A flush valve assembly of the type disclosed herein is utilized with water closet combinations comprising a bowl and a reservoir tank. When such a water closet combination is installed, the bowl is first affixed to the floor and the tank is then supported directly on the bowl in such a way that a flow conduit is provided from the tank to the bowl in order to effect the flush. A seal must be effected between the bowl and the tank to prevent undesirable leakage of flush fluid, normally water, and a valving mechanism must be provided along the flow conduit selectively to control the flow of water from the tank into the bowl. This valve must be capable of effectively closing the flow from the tank to the bowl; must be easily operated; must remain open only until the water reservoir in the tank has been evacuated during the flushing operation; and, must then quickly and efficiently close.

Historically, the flush valve employed a sealing element that was movable into and out of engagement with a seat presented from the tank. Some such sealing elements were movable vertically and some were swung arcuately between their open and closed positions. Vent and overflow tubes were separately provided in these historic configurations. A marked improvement over the early, prior art was provided when the flush valve combined the sealing, vent and overflow functions into a single assembly. Representative of that advance in the prior art are the valve assemblies disclosed in such prior U.S. patents as that to Fulton et al, No. 3,172,129, and that to Snyder et al, No. 3,267,491.

The coupled functions incorporated in such prior art valve assemblies provide a relatively compact arrangement of the components in the reservoir tank of the water closet, which permits a smaller reservoir tank to be employed.

As well as these coupled assemblies work, they do require a sealing element in the nature of a diaphragm of rather intricate cross-sectional configuration. The cost to manufacture such diaphragms, because of their configuration, has continuously increased over the years.

DISCLOSURE OF THE INVENTION

It is, therefore, a primary object of the present invention to provide an improved sealing means that is particularly adapted for use with a coupled flush valve assembly.

It is another object of the present invention to provide a sealing means for a flush valve assembly, as above, which sealing means employs a diaphragm having an uncomplicated cross-sectional configuration that is considerably less expensive to fabricate than the prior art configurations currently employed.

It is a further object of the present invention to provide sealing means for a flush valve assembly in which the diaphragm may be of still lesser overall diameter than that employed by even the most recent prior art.

It is yet another object of the present invention to provide a flush valve assembly that may itself be of concomitantly lesser diameter because of the lesser diameter of the diaphragm in order to permit the use of the assembly in water closets having smaller reservoir tanks.

These and other objects of the invention, as well as the advantages thereof over existing and prior art forms, will be apparent in view of the following detailed description of the attached drawings and are accomplished by means hereinafter described and claimed.

In general, a flush valve assembly embodying the concept of the present invention employs a spud having a tubular body portion that is insertably receivable within the discharge opening of a toilet reservoir tank. An annular flange extends radially of the body portion within the tank so that it can compress an appropriate sealing means circumferentially of the discharge opening in the tank in order to assure an adequate seal between the body portion of the spud and the tank.

Axially upwardly of the sealing flange, and thus also within the tank, an annular groove means extends peripherally of the body portion. A resilient, annular and substantially planar diaphragm is received within the groove and extends radially outwardly of the body portion.

A guide extends axially upwardly of the spud with a tube being slidable axially therealong. A skirt means is carried on the lower end portion of the tube and flares radially outwardly therefrom to define a circumferential valve seat releasably to engage the diaphragm carried by the annular groove. An anti-cavitation plate is carried radially between the valve seat and tube.

One preferred embodiment is shown by way of example in the accompanying drawings and hereinafter described in detail without attempting to show all of the various forms and modifications in which the invention might be embodied; the invention being measured by the appended claims and not by the details of the specification.

EXEMPLARY EMBODIMENT OF THE INVENTION

Figure 1:
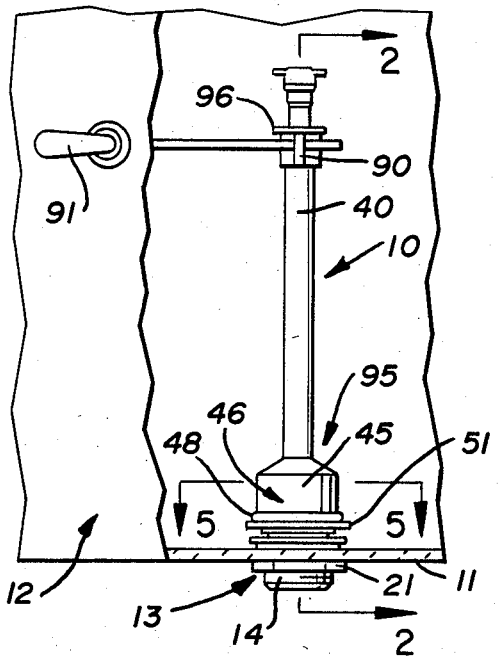
FIG. 1 is a frontal elevation of a reservoir tank on a reduced scale and partly broken away to depict one embodiment of a coupled flush valve assembly embodying the concept of the present invention operatively secured therein.
Figure 5:
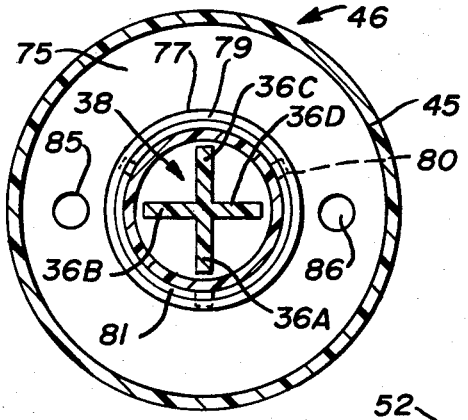
Figure 2:
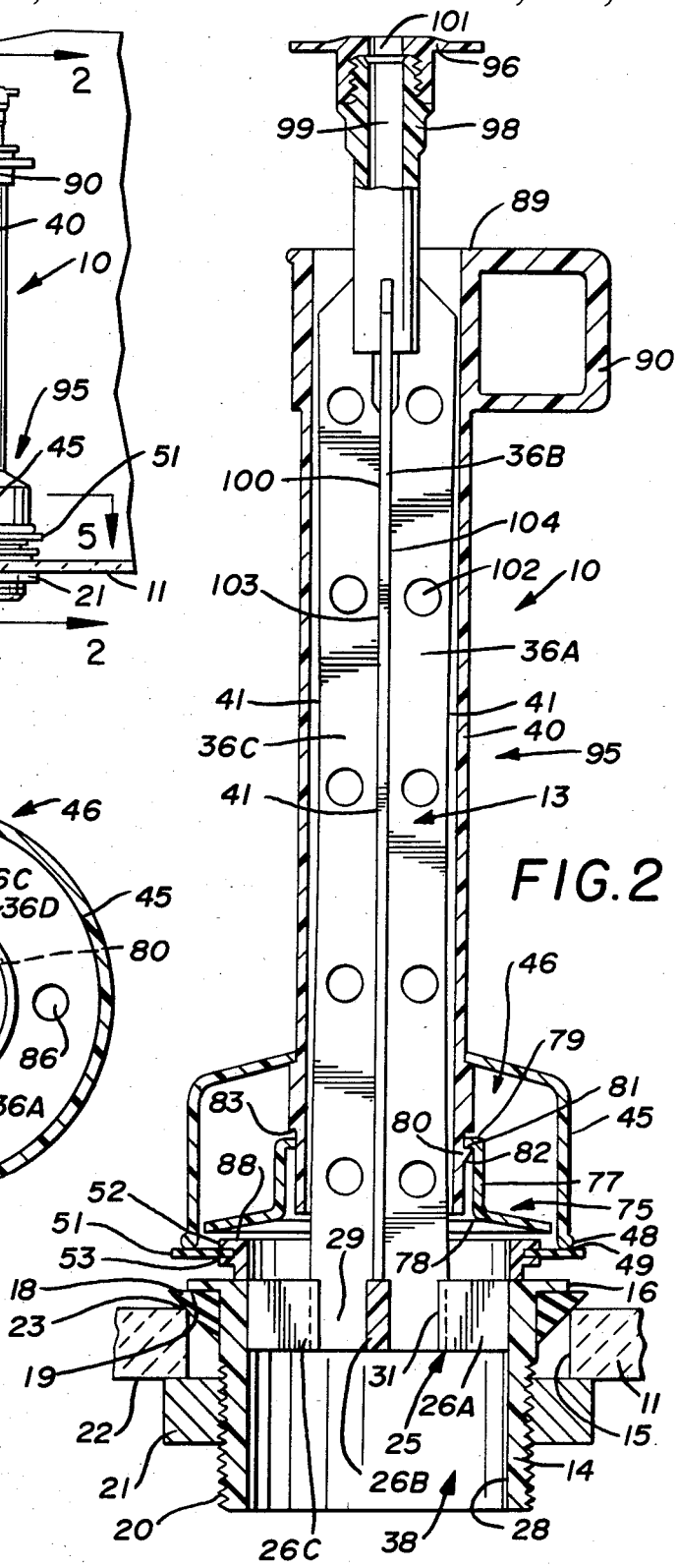
FIG. 2 is a vertical cross-section of a coupled flush valve assembly embodying the concept of the present invention and taken substantially along line 2—2 of FIG. 1.

A flush valve assembly for a water closet, which flush valve assembly embodies the concept of the present invention, is designated generally by the numeral 10 in FIGS. 1 and 2 of the accompanying drawings and is depicted as being demountably secured to the base 11 of a reservoir tank 12 for a water closet bowl (not shown).

The flush valve assembly 10 incorporates a spud 13, and it is the spud 13 that is demountably secured to the base 11. The spud 13 has a tubular body portion 14 that is insertably received within the discharge opening 15 through the base 11 of the reservoir tank 12. A circumferential mounting flange 16 extends radially from the body portion 14 and is disposed axially upwardly of the base 11. An annular gasket 18 encircles the body portion 14 of the spud 13 and bears against the lower surface 19 of the radial mounting flange 16.

At least the lowermost length of the tubular body portion 14 presents external threads 20 onto which a suitable retaining ring 21 may be received. Thus, in order to install the flush valve assembly, the body portion 14 of the spud 13, with the gasket 18 positioned thereon, is inserted downwardly through the discharge opening 15 in the base 11 of the tank 12. The retaining ring 21 is then screwed onto the threads 20 to be moved upwardly along the body portion 14 and into engagement with the undersurface 22 on the base 11 of the tank 12. Continued tightening of the ring 21 compresses the gasket 18 between the mounting flange 16 and the peripheral edge 23 of the discharge opening 15 to effect a water-tight seal between the body portion 14 of the spud 13 and the base 11 of the tank 12.

Figure 4:
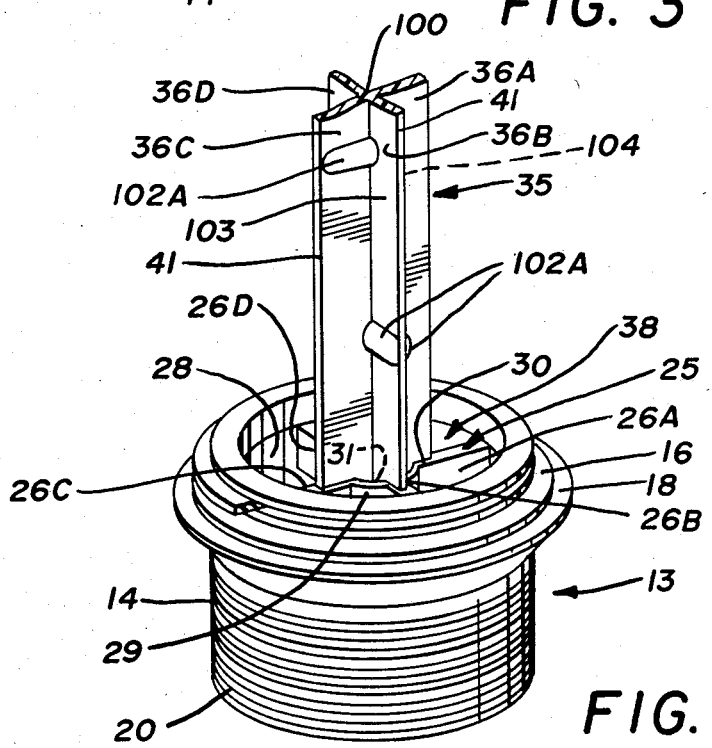
FIG. 4 is a perspective view of a portion of the spud employed by the flush valve assembly depicted in FIGS. 1 and 2 and depicting the tubular body portion thereof, the spider support presented across the interior of the body portion, the lowermost extent of the guide as it interconnects to the spider, and an alternative means by which to enhance fluid flow along the guide; and, FIG. 5 is an enlarged cross-section taken substantially along line 5—5 of FIG. 1 and appearing on the same sheet of drawings as FIGS. 1 and 2.

As is best seen in FIGS. 2 and 4, a spider 25 may be formed integrally within the body portion 14 of the spud 13. Four support legs 26A through 26D extend radially inwardly from the interior surface 28 of the tubular body portion 14 and terminate in a centrally located receiving ring 29. An appropriate number of axially aligned receiving grooves 30, as hereinafter more fully described, are recessed into the interior surface 31 of the ring 29.

The spud 13 also includes a multi-vaned guide portion 35 that is secured to, and extends axially upwardly from, the receiving ring 29. By the use of four vanes 36A through 36D, as shown, the lower ends of each of which are reduced in radial span for insertion into the appropriately located receiving groove 30, the guide portion 35 is provided with considerable stability. Although sufficient stability has been achieved by virtue of frictionally mounting vanes 36 within the appropriately disclosed groove 30, one may, if so desired, permanently affix the guide to the ring 29 by virtue of an appropriate cement, or the like.

Moreover, and by way of an even further variation, it is also quite feasible to mold the guide portion 35 integrally with the body portion 14. In that situation, the vanes 36 would, within the body portion 14, also merge with, and constitute, the support legs 26.

Any of the aforesaid arrangements assure the desired structural integrity of the spud 13 and yet only minimally restricts the flow passage 38 through the interior of the body portion 14.

A vent tube 40 slidably engages guide portion 35 of the spud 13 for vertical movement relative to the spud 13. The radially distal edge 41 of each vane 36 defines an axially oriented, slight inward curvature, or concavity, which extends along substantially the full medial portion of the guide 35. Such concavity assures non-binding movement of the vent tube 40 relative to the guide 35, and further assures that the vent tube 40 will be positioned in substantial concentricity with respect to the spud 13 upon closure of the valve assembly, also as more fully hereinafter discussed.

An outwardly and downwardly extending skirt 45 is carried concentrically about the lower portion of the vent tube 40 in such a manner as to define a bell-shaped, air retaining float 46. Such a float, as is appreciated by those skilled in this art, is necessary to prevent premature closure of the valve assembly 10 during the flushing operation. In fact, the float 46 is subject to a variety of hydrostatic forces. There is, for example, a downward force, resulting from the net water pressure acting on the float 46, that maintains the valve in its closed position when the reservoir tank is filled. Conversley, there is an upward force, resulting from the buoyancy of the float 46, that maintains the valve assembly 10 open during the flushing process.

These opposing forces tend to counteract each other, and it should therefore be appreciated that, in order for the valve assembly to operate effectively, the downward sealing force should be greater than the upward buoyant force when the valve assembly is in the closed position. Similarly, the upwardly directed buoyant force should be greater than the downward force when the valve assembly is in the open position.

The lowermost, radially distal rim 48 (FIG. 3) of the skirt 45 defines an annular valve seat 49 suitable for sealing engagement with the diaphragm of the now to be described, unique sealing means 50 employed by the valve assembly 10.

Figure 3:
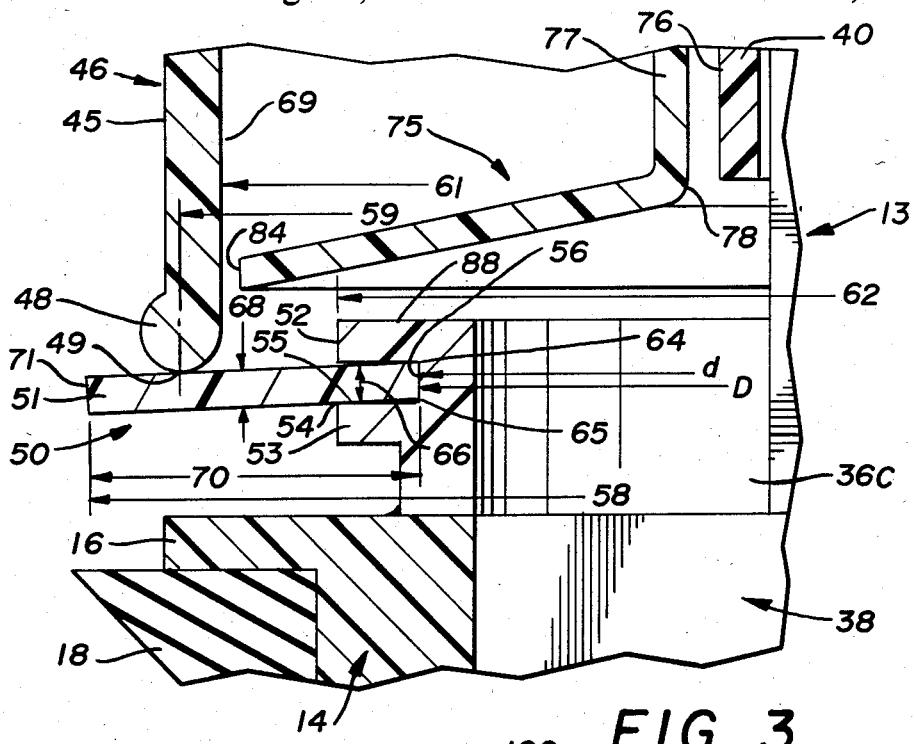
FIG. 3 is an enlarged fragmentary cross-section of an area of FIG. 2 depicting the details of the sealing means.

Referring generally to FIG. 2, but more particularly to FIG. 3, the sealing means 50 constitutes a resilient, annular and substantially planar diaphragm 51 as presented from a unique support incorporated in the body portion 14 of the spud 13 axially upwardly of the mounting flange 16. Specifically, a pair of axially spaced, annular lands 52 and 53 extend radially of the body portion 14 to define an annular groove 55 therebetween which extends peripherally of the body portion 14.

The sealing capabilities of the flush valve assembly 10 are achieved through the unique interrelation of the annular groove 55, the diaphragm 51 and the valve seat 49. Each of these elements must conform to specific design parameters, both individually and in combination with the other elements.

In this regard the annular groove 55 requires at least three specific parameters be met. First, the minor diameter (d) of the groove 55 should preferably be slightly greater than the free inside diameter (D) of the diaphragm 51—that is, when the latter is in a free, unstretched state. Second, the width, or axial dimension, of the groove 55 must be only slightly greater than the thickness of the diaphragm 51 so as to allow the latter to seat fully against the radially, inner surface 56 of groove 55 without interference with axially sidewall surfaces of the groove 55. Third, the upper and lower lands 52 and 53 which define the axial extent of the groove 55 must be concentric to the radially inner surface 56 of the groove 55 and must extend outwardly a sufficient distance to provide adequate cantilevered support to the diaphragm 51 when the valve is closed.

The annular diaphragm 51 is a generally planar and may be fabricated from an elastomeric material having good elastic memory capabilities, such as rubber. Diaphragm 51 has concentric inner and outer diameters. The outer diameter 58 of the diaphragm 51 must be greater than the diameter 59 of valve seat 49 while the inner diameter (D) of the diaphragm 51 is only slightly smaller than the minor diameter (d) of groove 55 such that a modest stretch of the diaphragm 51 occurs when it is received within the radial groove 55, thereby effecting an assured, continuing sealing contact with radially inner surface 56 of groove 55. Care must be taken to assure that the stretch imposed on the diaphragm 51 is not sufficient to alter its substantially planar configuration. That is, the diaphragm should not scallop, or otherwise deform, inasmuch as scalloping or other deformation could well prevent the necessary seal between the diaphragm 51 and the seat 49.

As discussed above, the entire support for the vent tube 40 and skirt 45, when the reservoir tank 12 is empty, is normally provided by the diaphragm 51, as it is contacted by the seat 49. The thickness of diaphragm 51, therefore, must be sufficient to provide cantilevered support to valve seat 49 irrespective of whether the reservoir is full or empty.

The rim 48 of the skirt 45 has an inside diameter 61 sufficiently greater than the outside diameter 62 of upper lands 52 so as to pass over the latter. The axial runout of valve seat 49 must be maintained within specific limits such that uniform and continuous contact between the valve seat 49 and the diaphragm 51 is achieved when the valve is closed.

Such a unique interrelation of these elements, each complimenting the other, provides for a multiple contact, fluid tight seal. Indeed, upon closure of the valve, no less than four areas of sealing contact are achieved. Specifically, the valve seat 49 bears down against diaphragm 51, thus defining one area of sealing. This action generates a force moment that causes the diaphragm 51 to pivot about the radially distal end 54 of the lower land 53, thereby defining a second area of sealing contact between the diaphragm 51 and the lower land 53. To counteract this downward deflection, the innermost region of the diaphragm 51 is forced upwardly against the radially proximal region 64 of the upper land 52, thereby defining a third sealing contact. The fourth area of sealing contact is defined by engagement of the radially inner surface 56 of groove 55 with the circumferential edge 65 defining the inner diameter (D) of the diaphragm 51, as caused by the initial stretch imparted to the diaphragm 51, as discussed above.

As a result of these four interrelated areas of sealing contact, the valve assembly 10 is capable of providing an effective, fluid tight seal under the relatively small net downward sealing force associated with flush valves of this type. Furthermore, the redundancy of sealing areas with respect to the radial groove 55 and the diaphragm 51 provide a margin of safety to preclude leakage which might otherwise occur as a result of nicks or cuts in the diaphragm 51.

In order to quantify a typical installation of a flush valve assembly embodying the concept of the present invention the flow passage 38 may be on the order of 2 inches (5.08 cm) in diameter and the upper and lower lands may extend approximately 7/32 inch (0.555 cm) outwardly beyond the inner surface 28 of the body portion 14. In such an installation the minor diameter (d) of the groove 55 could be on the order of 2-9/32 inch (5.794 cm). A typical diaphragm 51 for such an arrangement might well have an outer diameter of 3-3/32 inch (7.858 cm) and an inner diameter of 2-5/32 inch (5.477 cm) [it will be noted that these dimensions require that the diaphragm stretch to accommodate approximately a ⅛ inch (0.3175 cm) differential between the minor diameter (d) of the groove 55 and the inner diameter (D) of the diaphragm 51] with the thickness of the diaphragm being on the order of 1/16 inch (0.159 cm). In such a situation, the axial dimension, or thickness, 66 of the groove 55 should be at least a few thousandths of an inch (0.025 mm) greater than the thickness 68 of the diaphragm 51 to be seated therein, but preferably the groove 55 should not be much thicker than about 5/64 inch (0.198 cm).

These dimensions permit approximately ⅛ inch (0.3175 cm) insertion of the diaphragm 51 into the groove 55 and present a cantilevered portion extending approximately 11/32 inch (0.87 cm) radially outwardly beyond the lands 52 and 53. With the inner diameter 68 of the valve seat 49 (and thus the skirt 45) being approximately 2¾ inches (6.985 cm) a clearance of approximately 5/32 inch (0.397 cm) would be provided between the radially distal extent of the lands 52 and 53 and the interior surface 69 of the skirt 45. Assuming a radial dimension of approximately 1/16 inch (0.159 cm) for the seat 49, the diaphragm 51 would extend radially outwardly of the seat 49 no more than approximately 1/16 inch (0.159 cm).

Considering the aforesaid dimensional relationships in terms of the ratios involved, approximately one-fourth the span 70 of diaphragm 51 is received within the groove 55; the seat 49 engages the diaphragm 51 approximately one-fourth the span inwardly of the radially outer edge 71 thereof and approximately one-half the span between the radially inner and radially outer edges 65 and 71, respectively, of the annular diaphragm 51 constitutes the cantilever between the radially distal perimeter of the lands and the engagement of the seat 49 with the diaphragm 51.

Contributing significantly to the operative success of the flush valve assembly 10 is the employment of the annular anti-cavitation plate 75 interposed radially between the cylindrical outer surface 76 of the vent tube 40 and the interior surface 69 of the skirt 45. One means by which to secure the anti-cavitation plate 75 to the outer surface 76 of the tube 70 would be to provide an annular neck portion 77 which may extend axially upwardly from the radially inner circumference 78 of the anti-cavitation plate 75. The axially upper extent of the neck portion 77 terminates in a radially inwardly directed lip 79.

A plurality of retaining studs 80, normally three are spaced circumferentially about the periphery of the vent tube 40, extend radially outwardly from the surface 76 of the vent tube 40, as typified by the representation in FIG. 2, to present a ledge 81 to receive the lip 79. Each stud 80 also presents an inclined camming surface 82 axially beneath the ledge 81 to facilitate assembly. This arrangement permits the lip 79 to be forced axially along the camming surface 82 until it snaps into position on the ledge 81.

Typically, the ledge 81 extends radially outwardly from the surface 76 of the vent tube 80 approximately 0.015 inches (0.38 mm). That modest dimension taken in conjunction with the fact that only three studs 80 need be spaced circumferentially about the periphery of the vent tube 40 allows the lip 79 to follow axially along the camming surface 82 on the studs 80 with only minimal distortion of the lip 79 and the neck portion 77, which distortion is, of course, immediately relieved as the lip 79 snaps onto the ledge 81.

The interaction of the lip 79 and the ledge 81 prevents the anti-cavitation plate 75 from moving downwardly (as viewed in FIG. 2) off the vent tube 40, and one or more opposing shoulders 83 may be employed in axially spaced opposition to the ledges 81 to restrain the anti-cavitation plate 75 against movement axially upwardly along the vent tube 40 after the lip is seated on the ledges 81.

The shoulder 83 may extend continuously about the outer circumference of the vent tube 40, or, if desired to facilitate the manufacturing techniques employed, the shoulder 83 may be discontinuous about the periphery of the vent tube 40. For example, discontinuous shoulders may be disposed in direct physical opposition to each stud 80, or, alternatively, the shoulders 83 may extend along the peripheral span between successively located studs 80. In any event the shoulder 83 is spaced axially in effective opposition to the ledges 81 a distance only slightly greater than the axial dimension of the lip 79 so that the lip may be receivably confined therebetween.

It would, of course, be alternatively possible simply to secure the anti-cavitation plate 75 to the outer surface 76 of the vent tube 40, as by an adhesive suitable for the environment.

The radially outer periphery 84 of the anticavitation plate 75 may terminate in contiguous juxtaposition to the radially interior surface 69 of the skirt 45. It is not necessary that the periphery 84 of the anti-cavitation plate 75 sealingly engage the surface 69 of the skirt. In fact, when the plate 75 is of relatively planar configuration a pair of diametrically opposed drain ports 85 and 86 may penetrate the plate 75 to assure that any fluid within the float 46 can readily drain from the float and out through the flow passage 38. Such drainage may well also be induced by employing a plate 75 of modest conical configuration, as depicted, although a planar configuration has been found to provide quite satisfactory results.

The primary function of the anti-cavitation plate 75 is to prevent the turbulent flow of water, particularly as the valve is opened during the initiation of the flush, from displacing, or otherwise evacuating, the air within the float 46. It is, after all, the buoyancy provided by the air within the float 46 which prevents premature closure of the flush valve. It has been found that an absolute, air tight seal of the float 46 is not required. Hence, neither the drain ports 85 and 86 nor the failure to seal the anti-cavitation plate 75 against the inner surface 69 of skirt 45 renders the anti-cavitation plate 75 inoperative, and both permit egress, when the valve is closed, of even those water droplets that might form by condensation within the float 46.

Secondarily, the anti-cavitation plate 75 can serve as a positive, mechanical stop—by engagement with the upper rim 88 of the body portion 14 of the spud 13—should the seat 49, for any reason, be forced past the diaphragm 51.

The axially upper rim 89 (FIGS. 1 and 2) of vent tube 40 defines a safety overflow to limit the height of the water level in the tank 12 of the water closet. Indeed, should the inlet valve (not shown) of the water closet fail properly to close, the excess water could safely be discharged by spilling over the rim 89 of the vent tube 40 and out through the flow passage 38 and into the bowl of the water closet.

The upper extent of the vent tube 40 also presents a ring 90 which is suitable for connection to a standard flush valve lever 91 of a water closet. Upon actuation of the flush valve lever 91, the vent tube 40 is raised, thereby lifting valve seat 49 off the diaphragm 51 and commencing the flushing process. The extent of upward movement of valve element 95—comprising the overflow tube 40 and those elements supported therefrom—is determined by a stop cap 96 secured to the top of the guide portion 35. For ease of assembly and maintenance, stop cap 96 is preferably threaded onto the cylindrical, upper segment 98 of guide portion 35 such that it may be selectively removed.

A passage 99 extends axially through the upper segment 98 of guide portion 35 and opens in alignment with the intersection 100 of the vanes 36 and interiorly of the vent tube 40. A central port 101 through stop cap 96 opens into passage 99 and is suitable for receiving a standard water refill tube (not shown) of a water closet. Such an arrangement permits the refill water to flow along the vanes 36, by virtue of surface tension, and, thus, flow quietly through the flow passage 38 within spud 13 and into the water closet.

As heretofor mentioned, the passageway 38 not only provides the conduit along which the water closet bowl refill water flows, it also constitutes the overflow by which the flush fluid would exit from the tank in those situations such as when, for example, the input valve, or ball cock, might inadvertantly "stick" in the open position. In some environments the input flow rate could be quite high, and the passageway 38 should be configured to accommodate the maximum flow. It has been empirically determined that the flow rate through passageway 38 can be markedly enhanced by providing a plurality of apertures 102 at axially spaced intervals along one or more of the vanes 36, as depicted in FIG. 2. Similar enhancement of the flow rate through passageway 38 can be achieved by providing axially spaced, radially extending, ridge-like, semi-cylindrical protuberances 102A that project outwardly along the opposed faces 103 and 104 of each vane 36, as depicted in FIG. 4.

The advantages of the disclosed flush valve assembly 10, and the interrelation of its components, may be better recognized by considering the operation thereof through the complete flush cycle.

Prior to commencement of the flush cycle the hydrostatic pressure due to the water head, as well as the net weight of valve element 95, causes valve seat 49 to press firmly against diaphragm 51. This results in a modest downward deflection of the diaphragm 51 which, in turn, effects sealing contact of the four areas heretofore explained.

The flush is initiated by depressing the flush lever 91, mechanically attached to the connecting ring 90, to urge valve element 95 upwardly, thus lifting the valve seat 49 off the diaphragm 51. As the seal is broken between valve seat 49 and the diaphragm 51, the flow of water into the passage 38 through the body portion 14 of the spud 13 reduces the downwardly directed hydrostatic force on the valve element 95. The air space defined as float 46 provides a sufficient buoyant force to assist in raising the valve element 95 until the rim 89 of vent tube 40 strikes stop cap 96. Valve element 95 remains in that position until the water level in the tank 12 falls to the level where the buoyancy of float 46 just equals the weight of the valve element 95.

When the valve element 95 is first raised, the on-rush of water into spud 13 is in a highly turbulent flow condition. Some water will strike the anti-cavitation plate 75, creating an additional force to urge the valve element 95 upwardly. As such, the valve element 95 will rather quickly assume the fully opened position immediately following actuation of the flush lever 91.

As the reservoir tank 12 empties, the on-rush of water through that portion of the flow passage 38 within the body portion 14 of the spud 13 will subside and, also, the buoyancy level of the water in the tank 12 is lowered. As such, the valve element 95 will begin to lower in conjunction with the lowering of the water level. When the tank is substantially drained, the valve element 95 will lower to its initial position, and valve seat 49 will once again engage diaphragm 51. The weight of the valve element 95 is sufficient to deflect diaphragm 51, as discussed above, and effect the multiple contact seal whereby completely to stem the egress of water from the tank 12. The tank can then refill with water in preparation for the next flush cycle. Accordingly, as the tank refills, the downwardly directed hydrostatic pressure on the valve element 95 will increase proportionally such that an increasingly tighter seal will develop between the valve seat 49, the diaphragm 51 and the lands 52 and 53 which support the diaphragm 51.

In addition to the improved sealing qualities of the present flush valve assembly 10, the unique structural arrangement thereof provides a more compact structure than the prior art. By using the sealing arrangement disclosed herein, the overall diameter of the flush valve assembly has been reduced approximately 19 percent over even the most recent prior art. Such a reduction in the diameter of the valve assembly permits a corresponding reduction in the size of the reservoir tank of the water closet in which the valve assembly is employed, thereby rendering the water closet less aesthetically obstrusive.

It should, therefore, be appreciated that the interrelation of the elements of the flush valve assembly of the present invention provides a unique, compact, and heretofore unappreciated, sealing arrangement suitable for effecting fluid tight seals of flush valves of this type. As such, a flush valve assembly embodying the concept of the present invention achieves the various objects of the invention and otherwise constitutes an advantageous contribution to the art.

I claim:

1. A flush valve assembly for a water closet having a tank with a discharge opening comprising:

a spud having a tubular body portion with an outer generally cylindrical surface and an axially upper end;

a radial groove recessed in the outer surface of said tubular body portion in close proximity to its axially upper end, said body portion being adapted to be received in the discharge opening of a water closet tank with said radial groove positioned interiorly of the tank;

resilient gasket means carried by said radial groove and extending radially outwardly therefrom;

guide means extending axially upwardly from the tubular body portion of said spud and positioned interiorly of the tank;

tube means having a lower end portion and being slidably associated with said guide means;

skirt means carried by the lower end portion of said tube means, said skirt means extending outwardly from said tube means and defining a circular valve seat; and an anti-cavitation plate positioned interiorly of said skirt means, and being affixed to the lower end portion of said tube means;

said anti-cavitation plate defining a radially oriented wall between said skirt means and said tube means;

said anti-cavitation plate, said tube means and said skirt defining a bell like float cavity;

said anti-cavitation plate having means for draining said float cavity.

2. A flush valve assembly for a water closet having a tank with a discharge opening comprising:

a spud having a tubular body portion with an outer generally cylindrical surface and an axially upper end;

a radial groove recessed in the outer surface of said tubular body portion in close proximity to its axially upper end, said body portion being adapted to be received in the discharge opening of a water closet tank with said radial groove positioned interiorly of the tank;

resilient gasket means carried by said radial groove and extending radially outwardly therefrom;

guide means extending axially upwardly from the tubular body portion of said spud and positioned interiorly of the tank;

tube means slidably associated with said guide means;

tube means slidably associated with said guide means;

skirt means carried by the lower end portion of said tube means, said skirt means extending outwardly from said tube means and defining a circular valve seat; and an anti-cavitation plate positioned interiorly of said skirt means;

said anti-cavitation plate defines a radially oriented wall between said skirt means and said tube means;

said anti-cavitation plate has a radially inner, annular edge;

a collar circumscribes said vent tube and extends axially upwardly from the radially inner edge of said anti-cavitation plate;

a lip extends radially inwardly from the axially upper extent of said collar;

ledge means are presented on the radially outer surface of said vent tube, said lip engaging said ledge means to maintain said anti-cavitation plate on said vent tube.

3. A flush valve assembly, as set forth in claim 2, in which shoulder means are presented from the radially outer surface of said vent tube in opposition to said ledge means;

said lip being received between said ledge and shoulder means to secure said anti-cavitation plate to said vent tube.

4. A flush valve assembly, as set forth in claim 3, in which the ledge means is presented from a stud extending radially outwardly from said vent tube;

a camming surface is presented from said stud axially downwardly of said ledge means whereby to guide said lip into engagement with said ledge means.

* * * * *